US006361036B1

(12) United States Patent
Nakazawa

(10) Patent No.: US 6,361,036 B1
(45) Date of Patent: Mar. 26, 2002

(54) SHEET FINISHER POSITIONED BETWEEN UPSTREAM AND DOWNSTREAM ROLLERS AND TEMPORARILY INCREASING SPEED OF THE UPSTREAM ROLLERS WHILE MAINTAINING SPEED OF THE DOWNSTREAM ROLLERS

(75) Inventor: Yoshiki Nakazawa, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/528,739

(22) Filed: Mar. 20, 2000

(30) Foreign Application Priority Data

Mar. 25, 1999 (JP) ..... 11-081249

(51) Int. Cl.[7] ..... B26D 5/20

(52) U.S. Cl. ..... 270/58.07; 270/52.17; 83/167; 83/269; 83/370; 399/407

(58) Field of Search ..... 270/58.07, 58.08, 270/58.09; 83/52.17, 262, 269, 370, 110, 167, 372, 560, 156, 371; 399/407; 271/188, 209

(56) References Cited

U.S. PATENT DOCUMENTS 5,509,645 A * 4/1996 Shinno et al. ..... 83/167 X
5,746,162 A * 5/1998 Hosoi et al. ..... 270/58.09
6,014,920 A * 1/2000 Yamauchi et al. ..... 83/560

FOREIGN PATENT DOCUMENTS

| | | | |
|---|---|---|---|
| JP | 6-135620 | | 5/1994 |
| JP | 409110235 | * | 4/1997 |
| JP | 411005667 | * | 1/1999 |
| JP | 0200177922 | * | 6/2000 |

* cited by examiner

*Primary Examiner*—Kenneth W. Noland
*Assistant Examiner*—Patrick Mackey
(74) *Attorney, Agent, or Firm*—McDermott, Will & Emery

(57) ABSTRACT

A sheet finisher for an image forming apparatus that executes a precise and continuous punching at a specific position on a sheet while maintaining the conveyance speed of the sheet ejected from the image forming apparatus. The puncher is provided with the first and second conveyance rollers disposed along the conveyance direction of the sheet, in which the drive speed of the second conveyance roller disposed upstream in the conveyance direction is temporarily increased to form a loop of the sheet, and the punching device is driven so as to synchronize with the timing that the trailing edge of the sheet is detached from the second conveyance roller and brought into a temporal halt, thereby executing a punching precisely at the specific position on the sheet.

20 Claims, 10 Drawing Sheets

SHEET FINISHER POSITIONED BETWEEN UPSTREAM AND DOWNSTREAM ROLLERS AND TEMPORARILY INCREASING SPEED OF THE UPSTREAM ROLLERS WHILE MAINTAINING SPEED OF THE DOWNSTREAM ROLLERS

This application is based on application No. 11-81249 filed in Japan, the contents of which is hereby incorporated by reference.

BACKGROUND OF THE INVENTION

1. Field of the Invention

The present invention relates to a sheet finisher that executes a finishing processing, such as hole punching, etc., to a sheet ejected from an image forming apparatus.

2. Prior Art

There have been disclosed various types of a sheet finisher that receives sheets ejected from the image forming apparatus and punches binding holes (punching holes) at specific positions, and is used in installation close to the image forming apparatus.

Such a sheet finisher includes two types: one that temporarily collects sheets conveyed into a tray and then punches binding holes on the sheets collectively, and another one that punches binding holes on the sheet one by one on the way of conveyance.

The former holds an inconvenience that the collective punching will not permit such a processing as collation, sorting, paper jogging, etc., after punching. On the other hand, the latter holds an inconvenience being unsuitable for a high-speed punching, because the punching on the way of the conveyance of the sheet temporarily stops the conveyance thereof, and accordingly the subsequent sheet cannot be conveyed during the punching.

In an attempt to dissolve such inconveniences, a finisher by the rotary puncher has been proposed which can execute to a sheet the finishing, such as collation, sorting, paper jogging, etc., and which can punch the sheet without stopping the conveyance (refer to Japanese Laid Open Patent Publication No. Hei 6-135620).

In the finisher that temporarily stops the conveyance of a sheet on the way thereof and punches the sheet, the leading edge of the sheet is blocked by the resist roller so as to temporarily halt the conveyance, and the sheet is punched. Since the trailing edge of the sheet is still under conveyance during the punching, the sheet makes a loop as a whole during this period; and when the conveyance of the sheet is restarted, the loop of the sheet is dissolved.

Therefore, the spacing S between the preceding sheet and the succeeding sheet to be punched needs more than the spacing that corresponds to the total time T of the time t1 required for punching the preceding sheet and the time t2 required for the loop of the preceding sheet dissolving (T=t1+t2). If the conveyance speed of the sheet is given by V, the spacing will be expressed by S=V×T. That is, the preceding sheet and the succeeding sheet need to secure at least the foregoing spacing S between them.

Accordingly, to enhance the processing capacity needs to increase the conveyance speed, and to shorten the time required for the hole punching; however, the conveyance speed is subjected to the restriction by the speed of the sheet ejected from the image forming apparatus, which cannot be changed. Accordingly, to enhance the processing capacity needs to increase the punching speed, but to increase the speed involves size enlargement of the apparatus, creation of noises, and dispersion of hole positions, which are inconvenient.

And, in the finishing by the foregoing rotary puncher, it is not needed to give a spacing between the preceding sheet and the succeeding sheet, but since the leading edge of the sheet is not made to be blocked by the resist roller, the leading edge thereof becomes irregular, so that the hole positions become dispersed, which is also inconvenient.

SUMMARY OF THE INVENTION

A major object of the invention is to provide a novel sheet puncher that executes a punching to a sheet ejected from an image forming apparatus on the way of the conveyance while maintaining the conveyance speed of the ejected sheet.

Another object of the invention is to provide a novel image forming apparatus that executes a finishing processing such as a punching at a high speed on the way of the conveyance of the sheet while maintaining the conveyance speed of the sheet that has completed an image recording and is ejected from the image forming apparatus.

Another object of the invention is to provide a novel sheet finisher that executes a finishing processing such as a punching on the way of the conveyance to a sheet ejected from the image forming apparatus while maintaining the conveyance speed of the ejected sheet.

Another object of the invention is to provide a novel sheet puncher that temporarily increases the speed of one conveyance roller disposed upstream in the conveyance direction, of a pair of conveyance rollers disposed along the conveyance direction of the sheet, operates a punching mechanism when the trailing edge of the sheet to be conveyed is brought in a temporal halt, and executes a precise punching at a specific position on the sheet.

Other objects and features of the invention will become apparent from the detailed description of the invention in conjunction with the accompanying drawings.

DETAILED DESCRIPTION OF THE PREFERRED EMBODIMENTS

The preferred embodiment of the invention will be described with reference to the accompanying drawings.

Figure 1:
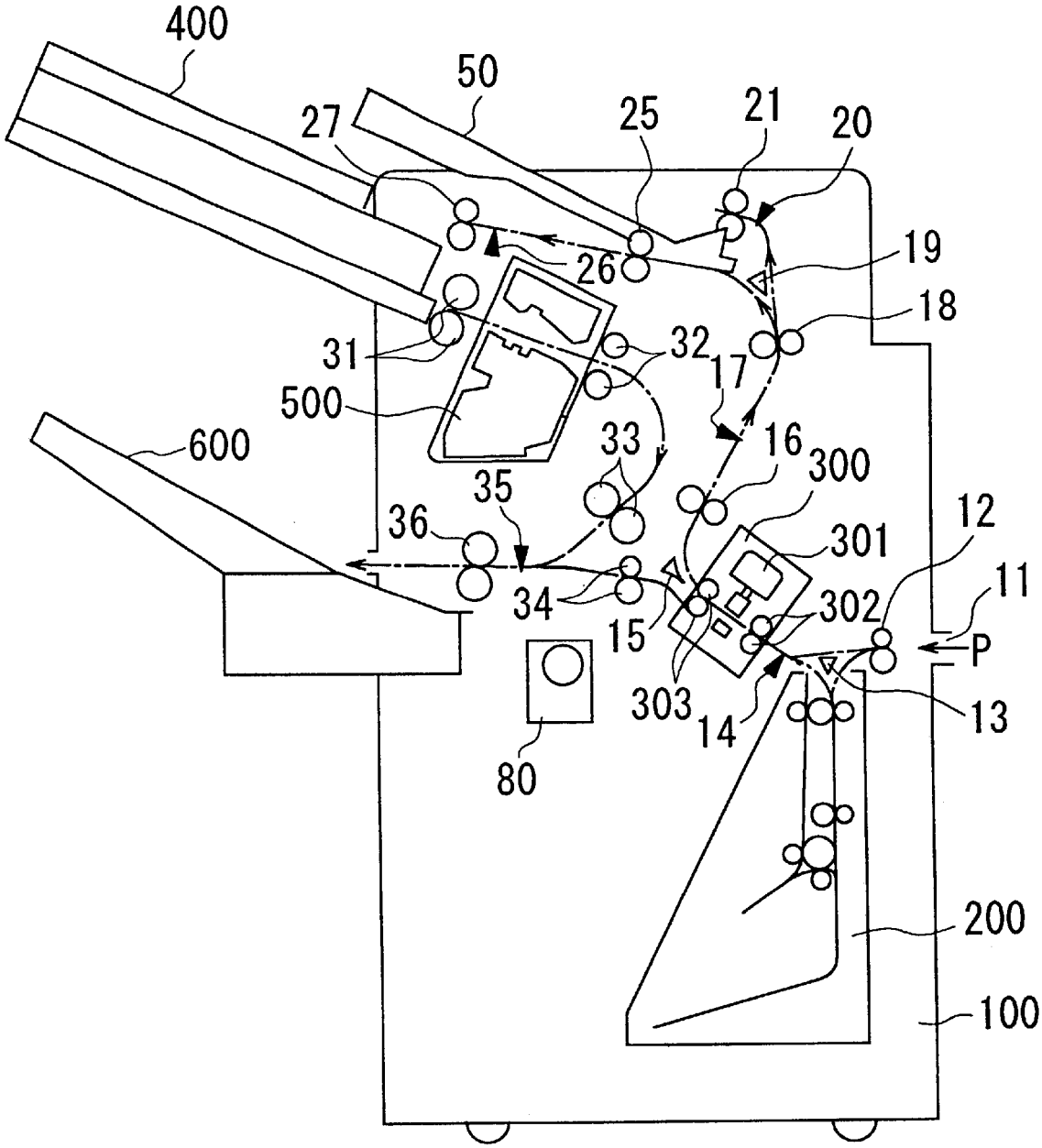
FIG. 1 is a sectional view illustrating a construction of a sheet finisher of one embodiment of the present invention.

FIG. 1 is a sectional view illustrating a construction of a sheet finisher relating to the embodiment of the invention. In FIG. 1, 100 denotes the sheet finisher, 200 a sheet folding unit, 300 a punching assembly, 400 a sheet accumulation unit, 500 a stapling unit, and 600 a second ejection tray. Also, 11 denotes a sheet inlet which a sheet P is carried into, 50 a first ejection tray, and 80 a drive control unit.

The punching assembly 300 includes a punching unit 301, a first punching conveyance roller 303 disposed on the downstream of the punching unit 301, a second punching conveyance roller (resist roller) 302 disposed on the upstream of the punching unit 301, and the other components, the detail of which will be described later. Here, the sheet folding unit 200 and the stapling unit 500 take on the well-known construction, and the detail is omitted.

The outline of the sheet finisher 100 will be explained. Along a sheet conveyor from the sheet inlet 11 until the downstream of the punching assembly 300 are disposed a conveyance roller 12, a conveyor switching claw 13, and a sheet sensor 14; and on the downstream of the punching assembly 300 is disposed a conveyor switching claw 15.

The conveyor switching claw 13 is to switch the conveyor so that the sheet is conveyed to the sheet folding unit 200, and the conveyor switching claw 15 disposed on the downstream of the punching assembly 300 is to switch the conveyor into the first ejection tray 50 or the second ejection tray 600.

Along a sheet conveyor from the conveyor switching claw 15 toward the first ejection tray 50 are disposed a conveyance roller 16, a sheet sensor 17, a conveyance roller 18, and a conveyor switching claw 19, in which the sheet conveyor is designed to be switched by the conveyor switching claw 19 into the first ejection tray 50 or the sheet accumulation unit 400.

Along a sheet conveyor toward the first ejection tray 50 are disposed a sheet sensor 20 and a conveyance roller 21. And, along a sheet conveyor toward the sheet accumulation unit 400 are disposed a conveyance roller 25, a sheet sensor 26, and a conveyance roller 27.

Along a sheet conveyor toward the second ejection tray 600 are disposed a conveyance roller 34, a sheet sensor 35, and a conveyance roller 36.

In order to bind the accumulated sheets in the sheet accumulation unit 400, the stapling unit 500 is disposed on the downstream of the sheet accumulation unit 400, and sheet bundle pressure rollers 31, 32 are disposed before and after the stapling unit 500. Further, a bundle conveyance roller 33 is disposed on the downstream thereof, and the sheet conveyor in this part communicates with the sheet conveyor toward the foregoing second ejection tray 600.

Next, the operation of the sheet finisher will briefly be explained. The operation of the sheet finisher 100 is controlled by the drive control unit 80 described later, and the conveyance speed of the sheet by the conveyance rollers is controlled to be constant, except for the punching by the punching assembly 300 described hereafter.

When a sheet folding instruction is issued from the operation panel on the copying machine, the conveyor switching claw 13 is switched so that the sheet P carried in the sheet inlet 11 can be carried to the sheet folding unit 200, where the sheet P is folded and carried toward the downstream (the punching assembly 300).

When the sheet folding instruction is not issued, the conveyor switching claw 13 is switched so that the sheet P carried in the sheet inlet 11 can be carried to the punching assembly 300.

When a punching instruction is issued from the operation panel on the copying machine, the sheet P is carried by the first punching conveyance roller 303 and the second punching conveyance roller (having a function as a resist roller) 302, and it passes through the punching assembly 300. At this moment, the trailing edge of the sheet P is positioned by the second punching conveyance roller 302, as described later; and the sheet P is punched by the punching unit 301 and is carried downstream.

When a non-punching instruction is issued from the operation panel on the copying machine, the sheet P is carried by the first punching conveyance roller 303 and the second punching conveyance roller 302, and is carried downstream without punching.

When a stapling instruction is issued from the operation panel on the copying machine, the conveyor switching claw 15 and the conveyor switching claw 19 are switched so that the sheet P is carried to the sheet accumulation unit 400, in which the sheet P is accumulated by one set each. One set of the accumulated sheets is pressurized into one bundle by the sheet bundle pressure rollers 31, 32 disposed before and after the stapling unit 500; and then the bundle is stapled by the stapling unit 500, and ejected into the second ejection tray 600 through the bundle conveyance roller 33 and the conveyance roller 36.

The second ejection tray 600 is designed so that the tray can be shifted up and down, right and left by a driving source not illustrated to carry out the sorting of the sheets (called as shift sorting). Further, the second ejection tray 600 is made so as to shift the vertical position of the tray in accordance with the number of the sheets ejected.

When a sorting instruction is issued from the operation panel on the copying machine, the conveyor switching claw 15 is switched so that the sheet P is carried to the second ejection tray 600. The sheets P carried in the sheet inlet 11 are ejected into the second ejection tray 600, and the sheets are sorted in the second ejection tray 600.

When a non-sorting instruction is issued from the operation panel on the copying machine, the conveyor switching claw 15 and the conveyor switching claw 19 are switched so that the sheet P is carried to the first ejection tray 50. The sheets P carried in the sheet inlet 11 are ejected into the first ejection tray 50.

Figure 2:
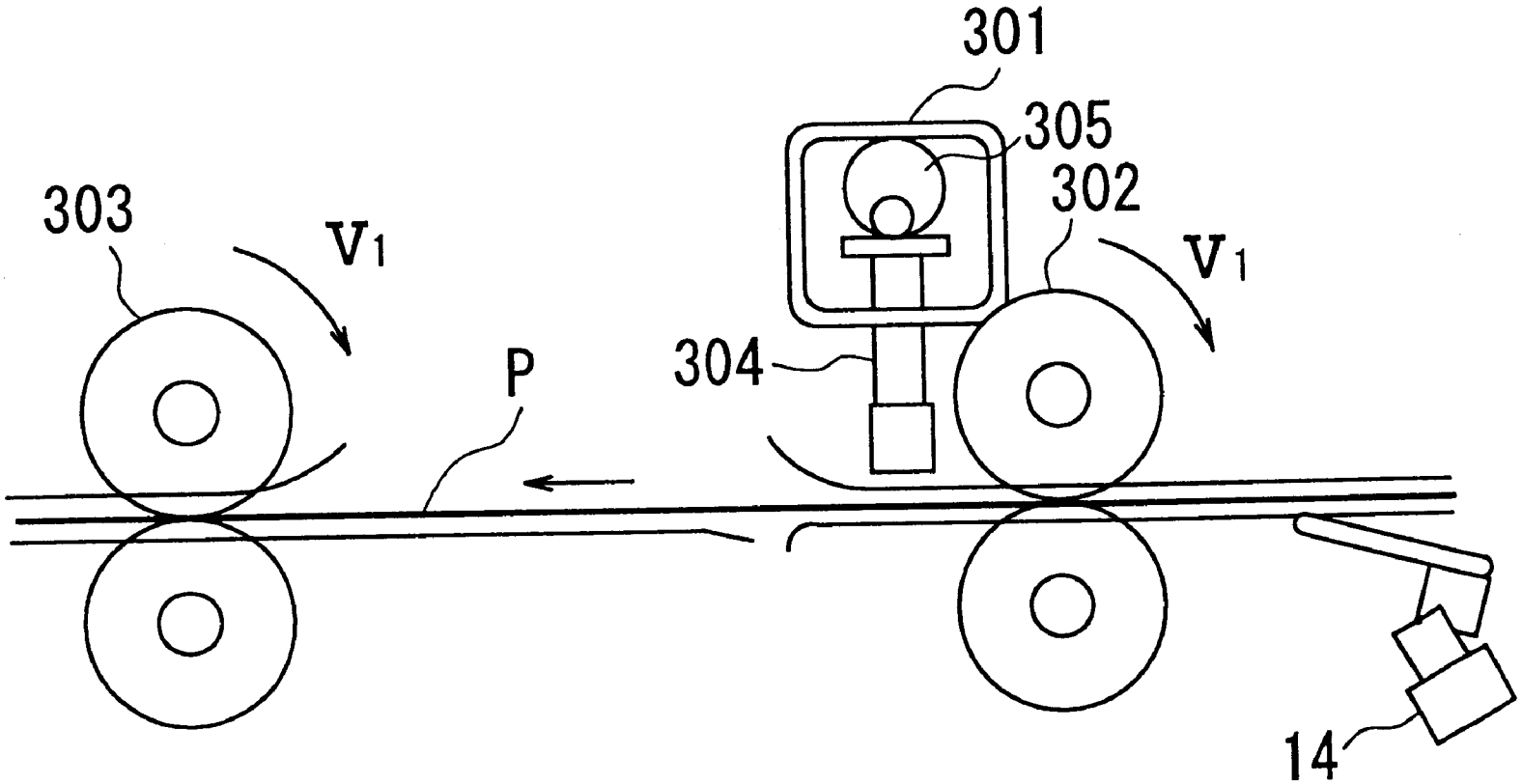
FIG. 2 is a side view illustrating a construction of a major part of a punching assembly (sheet conveying state)
Figure 3:
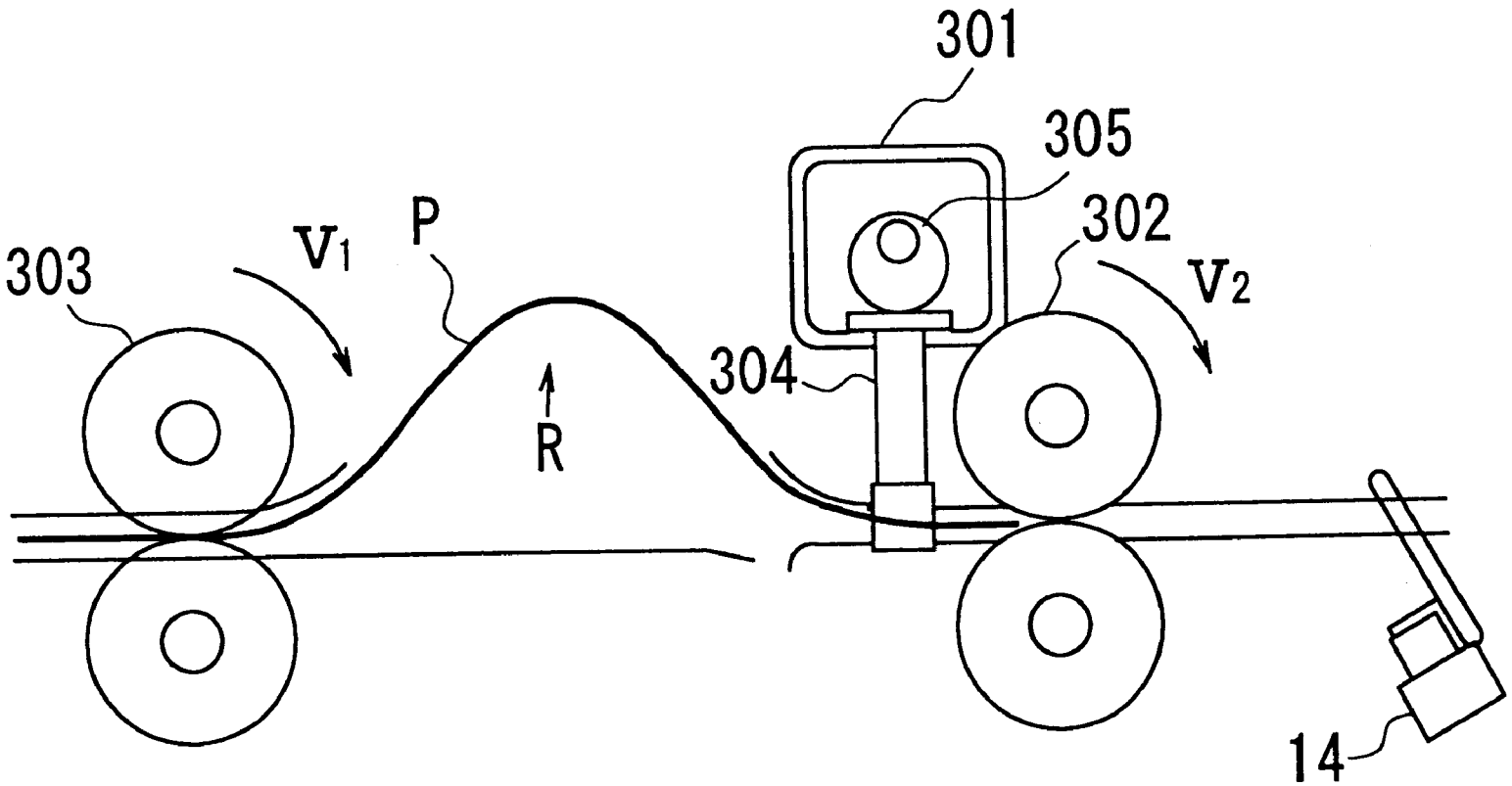
FIG. 3 is a side view illustrating a construction of a major part of a punching assembly (punching state)
Figure 4:
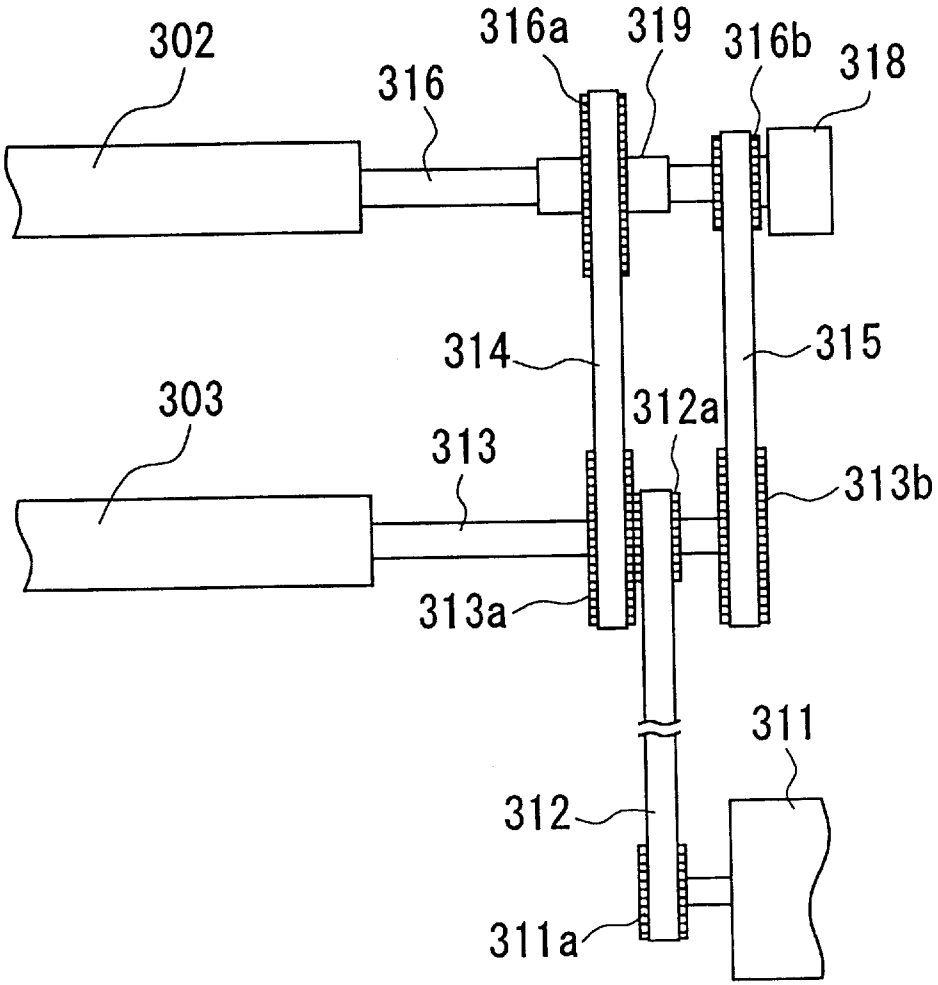
FIG. 4 is a plan view illustrating a construction of the drive mechanism of a resist roller and a conveyance roller.
Figure 5:
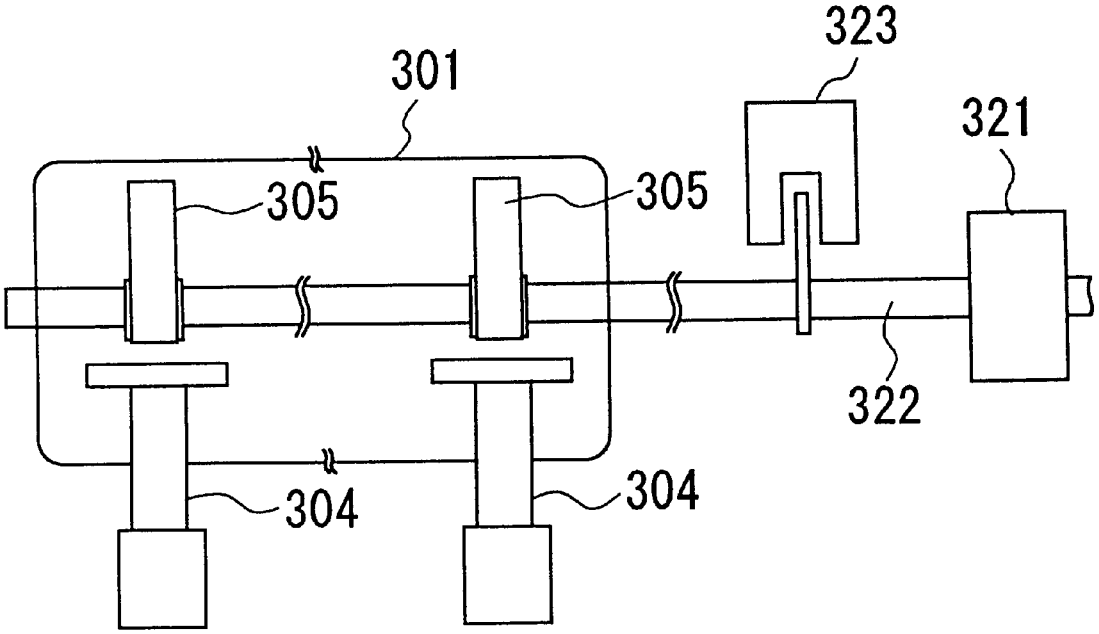
FIG. 5 is a front view illustrating a construction of the punching unit drive mechanism.

Next, the construction and operation of the punching assembly 300 of this embodiment will be explained. FIG. 2 and FIG. 3 are side views illustrating the construction of the major part of the punching assembly 300. FIG. 2 illustrates a state in which the sheet P is conveyed, and FIG. 3 illustrates a state in which the sheet P is punched. FIG. 4 is a plan view explaining the construction of the drive mechanism of the second punching conveyance roller 302 and the first punching conveyance roller 303, and FIG. 5 is a front view explaining the construction of the drive mechanism of the punching unit 301.

As shown in FIG. 1, FIG. 2, and FIG. 3, the punching assembly 300 includes the punching unit 301, the second punching conveyance roller 302 disposed on the upstream thereof, and the first punching conveyance roller 303 disposed on the downstream thereof. On the upstream of the second punching conveyance roller 302 is disposed the sheet sensor 14, and between the punching unit 301 and the first punching conveyance roller 303 is provided a space such that the sheet P can form a loop R of a specific size therein.

The second punching conveyance roller 302 is provided with a construction that drives the conveyor at a first conveyance speed V1 being the normal sheet conveyance speed and at a second conveyance speed V2 which is higher than V1. FIG. 4 is a plan view explaining the drive mechanism of the first punching conveyance roller 303 and the second punching conveyance roller 302, in which a drive shaft 313 of the first punching conveyance roller 303 is driven by a motor 311 being a power source through a sprocket wheel 311*a* connected to the motor 311, a transmission chain 312, and a sprocket wheel 312*a*.

The drive shaft 313 has a sprocket wheel 313*a* and a sprocket wheel 313*b* attached there. On the other hand, a drive shaft 316 of the second punching conveyance roller 302 has a sprocket wheel 316*a* connected through a one-way clutch 319. Further, the drive shaft 316 has a sprocket wheel 316*b* whose number of teeth is fewer than that of the sprocket wheel 313*b* connected through a clutch 318 controlled by the drive control unit 80 described later.

The first punching conveyance roller 303 is driven at the first conveyance speed V1 by the motor 311 through the sprocket wheel 311*a*, the transmission chain 312, the sprocket wheel 312*a*, and the drive shaft 313.

In the drive at the first conveyance speed V1 of the second punching conveyance roller 302, which is the normal conveyance state of the sheet, the rotation of the sprocket wheel 313*a* on the drive shaft 313 driven through the foregoing transmission passage is transmitted to a transmission chain 314, the sprocket wheel 316*a*, the one-way clutch 319, and the drive shaft 316, thus driving the second punching conveyance roller 302. In this state, the clutch 318 is not operational, and the sprocket wheel 316*b* is not coupled with the drive shaft 316.

In the drive at the second conveyance speed V2, which is higher than the speed V1, of the second punching conveyance roller 302, the clutch 318 is operational, and the sprocket wheel 316*b* is coupled with the drive shaft 316. Thereby, the rotation of the sprocket wheel 313*b* on the drive shaft 313 driven through the foregoing transmission passage is transmitted to a transmission chain 315, the sprocket wheel 316*b*, the clutch 318, the drive shaft 316, and the second punching conveyance roller 302 is driven at the second conveyance speed V2.

In this state, the rotation speed of the drive shaft 316 is higher than that of the sprocket wheel 316*a*, and the one-way clutch 319 is operational; and accordingly, the sprocket wheel 316*a* is separated from the drive shaft 316.

FIG. 5 is a front view explaining a construction of the drive mechanism of the punching unit 301. The punching unit 301 includes a clutch 321 that transmits the rotational driving force from a power source not illustrated to a drive shaft 322, an eccentric cam 305 rigidly connected to the drive shaft 322, and punch 304 driven up and down by the eccentric cam 305, which is driven by the control of the drive control unit 80 described later. Further, the drive shaft 322 is provided with a punch position sensor 323 in order to detect whether the punch is set at a home position (return position) outside the conveyor of the sheet.

Also, the eccentric cam 305 and the punch 304 are laid out each in plural sets in the direction perpendicular to the conveyance direction of the sheet, whereby a desired number of holes can be punched.

Next, the operation of the first punching conveyance roller 303 and the second punching conveyance roller 302, and the punching unit 301 will be explained.

When the sheet P is detected by the sheet sensor 14 disposed on the upstream in the conveyance direction of the sheet, the drive control unit 80 described later switches the conveyance speed of the second punching conveyance roller 302 from the speed V1 into the speed V2 higher than V1.

Since the sheet conveyance speed of the first punching conveyance roller 303 is the speed V1, by the conveyance speed difference of the first and second punching conveyance rollers, the loop R of the sheet P is formed between the first punching conveyance roller and the second punching conveyance roller (FIG. 3). When the trailing edge of the sheet P passes through the second punching conveyance roller 302, the trailing edge of the sheet P is brought into contact with the nip of the second punching conveyance roller 302 by a repulsion of the looped sheet. This state is maintained until the loop is dissolved, and the trailing edge of the sheet P is positioned accordingly.

In the state that the trailing edge of the sheet P is positioned, the punching unit 301 is driven to punch the sheet within a time until the loop is dissolved. Since the trailing edge of the sheet P is positioned, the punching position is not dispersed. And, since the sheet P is continuously conveyed by the first punching conveyance roller 303, the loop is dissolved with the passage of time, and the sheet P can be punched in continuous conveyance.

When the punching operation of the sheet P is completed, and the trailing edge of the sheet P is detached from the nip of the second punching conveyance roller 302, the loop is dissolved. At this moment, since the leading edge of the succeeding sheet can be brought to the nip on the entrance side of the second punching conveyance roller 302, a spacing is not necessary to be made between the preceding sheet and the succeeding sheet.

Now, the punching unit operation time will be explained.

Provided that the conveyance speed of the first punching conveyance roller is given by V1, the conveyance speed of the second punching conveyance roller is given by V2, and the distance between the trailing edge of the sheet (being also the position where the sheet sensor 14 is disposed) and the nip of the second punching conveyance roller is given by L, the loop formation time t1 (from the time the trailing edge of the sheet is detected by the sheet sensor 14 to the time the trailing edge of the sheet is brought into contact with the nip of the second punching conveyance roller, and the trailing edge is positioned) is given by the following.

$$t1=L/V2 \quad (1)$$

The size of the loop R at this moment is:

$$R=t1\times(V2-V1) \quad (2)$$

The time t2 until the loop is dissolved, namely, the punching unit operation permissible time is:

$$t2=R/V1 \quad (3)$$

From the foregoing equations (1), (2), (3), the distance L between the trailing edge of the sheet (being also the position where the sheet sensor 14 is disposed) and the nip of the second punching conveyance roller can be expressed as follows.

$$L=t2\times V1\times V2/(V2-V1) \quad (4)$$

Since the punching unit operation time is determined by the construction, and the conveyance speed V1 is specified by the image forming apparatus, for obtaining a necessary loop R, it is only needed to determine the conveyance speed V2 and the disposition of the sheet sensor 14 through alignment.

Figure 6:
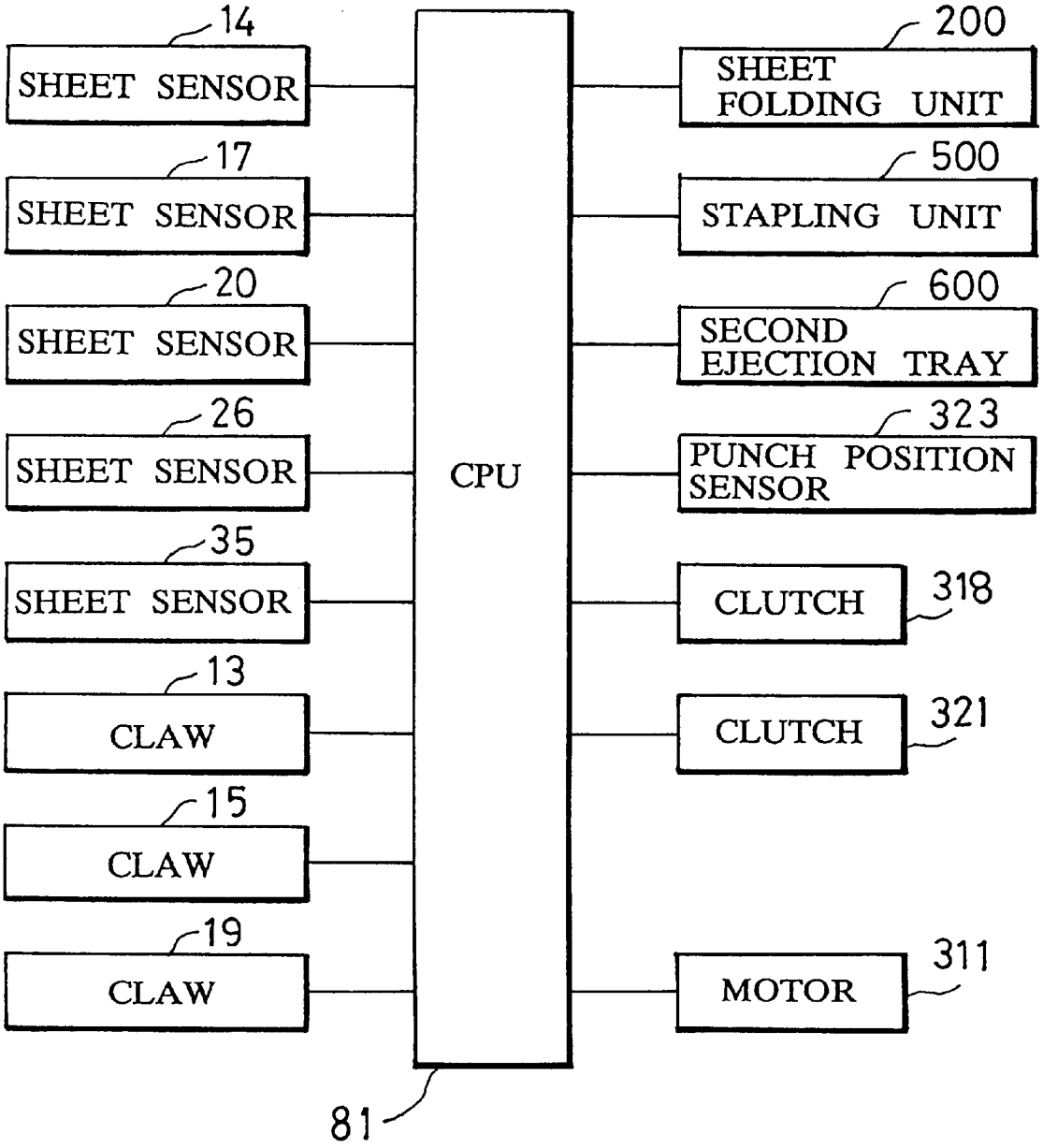
FIG. 6 is a block diagram illustrating the configuration of a control circuit.

FIG. 6 is a block diagram illustrating the configuration of the drive control unit 80 that controls the operation of the finisher 100. The drive control unit 80 includes a CPU 81, to the input/output ports of which are connected the motor 311 being the power source for the conveyance rollers of the sheet and the punching assembly, etc., and in addition, the sheet folding unit 200, the stapling unit 500, and the second ejection tray 600. The second ejection tray 600 is controlled by the CPU 81 in order for executing the shift sorting.

Further, to the input ports of the CPU 81 are connected the sheet sensors 14, 17, 20, 26, 35, and the punch position sensor 323 of the punching assembly as well. To the output ports thereof are connected the conveyor switching claws 13, 15, 19, and in addition, the clutch 318 for the drive shaft 316 that drives the second punching conveyance roller, and the clutch 321 for the drive shaft 322 that drives the punching assembly 300.

Next, referring to the flowcharts in FIG. 7 and FIG. 8, and FIG. 1 through FIG. 5, the control operation of the drive control unit 80 will be described.

Figure 7:
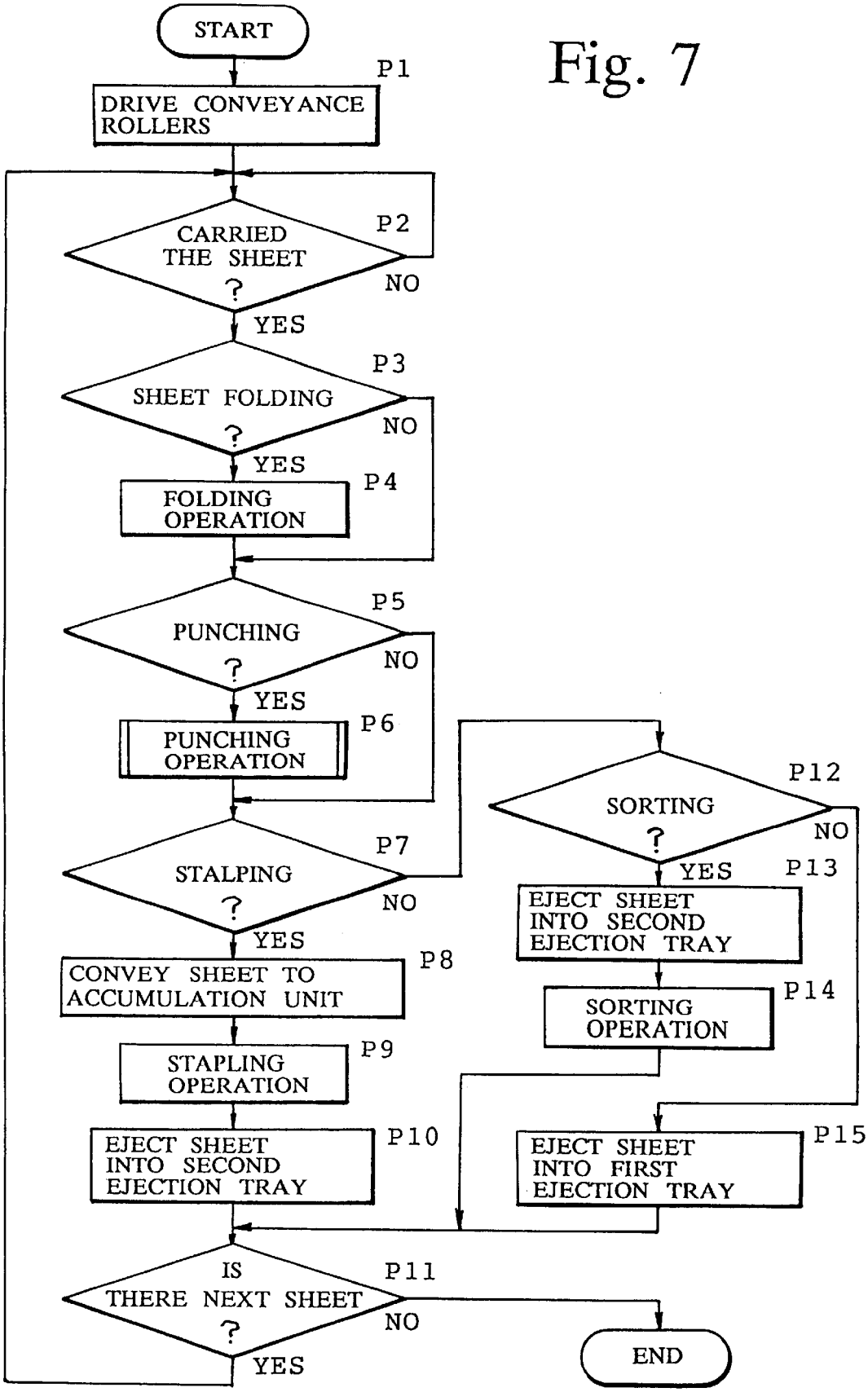
FIG. 7 is a flowchart explaining the operation to control the sheet finisher.

FIG. 7 is a flowchart explaining the total operation of the finisher 100. First, the conveyance speed of the sheet P by the conveyance rollers in the finisher 100 is controlled so that the specific conveyance speed V1 can be maintained except for the punching in the punching assembly 300 described hereunder (step P1).

The state of the sheet sensor 14 is judged (step P2), and if the copied sheet P carried in the sheet inlet 11 is detected, whether or not the folding instruction is present is judged (step P3). If the folding instruction is present, the conveyor switching claw 13 is switched so that the sheet P is conveyed to the folding unit 200, where the sheet P is folded (step P4), and the folded sheet P is conveyed downstream.

Whether the punching instruction is present is judged (step P5), and if the punching instruction is present, the punching operation is carried out by the punching assembly 300 (step P6), and the sheet P is conveyed downstream.

Whether the stapling instruction is present is judged (step P7), and if the stapling instruction is present, the conveyor switching claws 15 and 19 are switched so that the sheet P is conveyed to the accumulation unit 400, where the sheet P is accumulated (step P8). The accumulated sheets are stapled by the stapling unit 500, and the stapled sheet bundle is ejected into the second ejection tray 600 (step P9, P10).

Whether the sheet P to be finished is present is judged (step P11), if it is present, the processing returns to step P2, and if not, the processing is terminated.

At the judgment at step P7, if it is non-stapling instruction, whether it is the sorting instruction is judged (step P12); and if it is the sorting, the sheet P is carried to the second ejection tray 600 to carry out the sorting (step P13, P14), and the processing transfers to the step P11 and after. At the judgment at step P12, if it is not the sorting, namely, it is the non-sorting, the conveyor switching claws 15 and 19 are switched so that the sheet P is carried to the first ejection tray 50, and the sheet P is ejected into the first ejection tray 50 (step P15), and the processing transfers to the step P11 and after.

Figure 8:
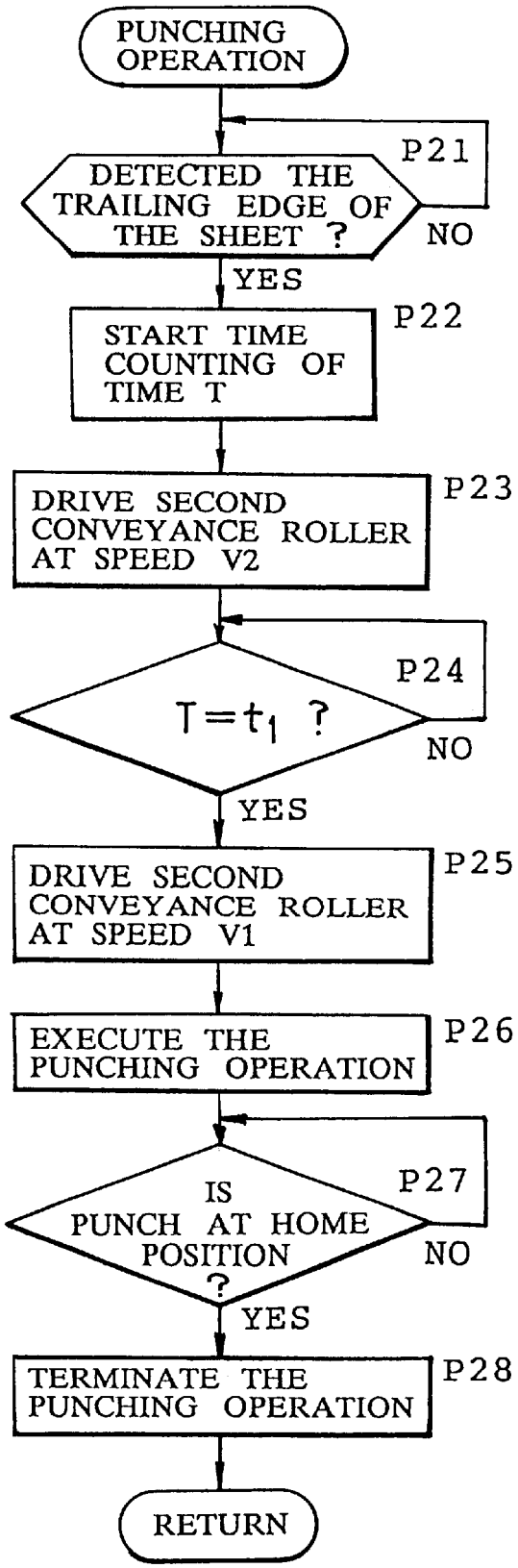
FIG. 8 is a flowchart explaining the control operation of the punching processing.

FIG. 8 is a flowchart explaining the control of the punching operation illustrated at step P6 in FIG. 7. Here, in the initial state, the second punching conveyance roller 302 and the first punching conveyance roller 303 are assumed to be controlled to carry the sheet P at the specific conveyance speed V1.

First, the processing waits for the trailing edge of the sheet P being detected by the sheet sensor 14 (step P21). Here, the disposition of the sheet sensor 14 is set such that the distance between the trailing edge of the sheet P and the nip of the second punching conveyance roller 302 becomes equal to the specific value L, when the trailing edge of the sheet P is detected.

When the trailing edge of the sheet P is detected, the processing starts to count the time T representing the feed length of the sheet P by the second punching conveyance roller 302 (step P22). At the same time as starting to count the time T, it operates the clutch 318 (see FIG. 4), switches the conveyance speed of the second punching conveyance roller 302 into the speed V2, and starts conveying the sheet P at the higher speed (step P23).

It is judged whether the time T representing the feed length of the sheet P counts up to the time t1 corresponding to the specific loop formation (step P24); and if the time T does not count up to the time t1, the processing returns to step P24 to continue the conveyance of the sheet P at the higher speed, but if it counts up to t1 (T=t1), the conveyance speed of the second punching conveyance roller 302 is switched into the speed V1 (step P25), and at the same time the punching is started.

In the execution of the punching, first, the clutch 321 is operated to rotate the drive shaft 322, which executes the punching operation by the punch 304 (step P26). The punch position sensor 323 detects whether the punch 304 is returned to the home position outside the conveyor of the sheet (step P27); and if they are returned, the clutch 321 is disconnected and stops the rotation of the drive shaft 322 (step P28), thus terminating the punching operation and returns to the main routine.

Figure 9:
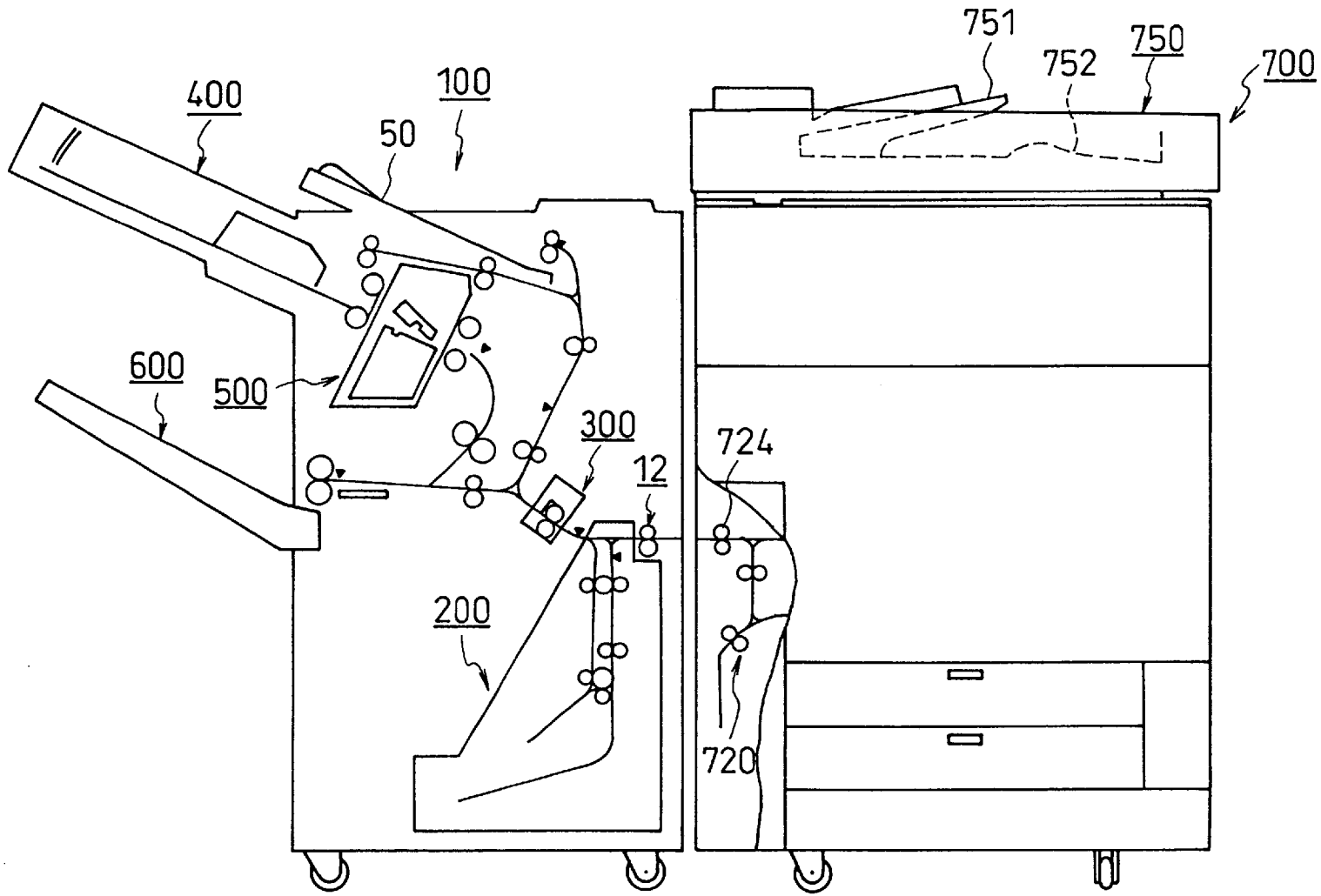
FIG. 9 is a sectional view illustrating an outline of an image forming apparatus configured with the finisher coupled to a copying machine.

FIG. 9 is a schematic sectional view of an image forming apparatus being one embodiment of the invention, which is configured with the finisher 100 coupled to a copying machine 700.

The copying machine 700 to which the finisher 100 is coupled is the so-called digital copying machine, in which document images are read and stored in an image memory, the images are edited in various ways as needed, thereafter the images are formed on a sheet by the well-known electrophotographic technology, and the copied sheets are ejected one by one from a sheet ejection unit 724 to the finisher 100.

The copying machine 700 has an automatic document feeder 750 (hereunder, mentioned as ADF) incorporated on the top of copying machine 700. This ADF 750 feeds one or more documents set in a document tray 751 one by one onto the platen glass (not illustrated) of the copying machine 700, and ejects to pile up the original documents whose image readout has been finished into an ejection tray 752.

The copying machine 700 of this embodiment starts copying operation from the first page of the documents, which is the so-called the first page system, in which the documents are set in the document tray 751 of the ADF 750 with the first page facing upward. In case of the double sided copying, for example, that copies the images on single sided document to both sides of one sheet, the copying machine of the so-called the first page system is not necessary to designate or detect whether the documents are made of an odd number of sheets or an even number, and the copying operation can be made rapidly, which is advantageous.

The images on the document set on the platen glass of the copying machine by the ADF 750 are read by the image reader (not illustrated) incorporated in the copying machine 700, and converted into the digital data to be stored in the memory. The copying operation is executed by reading out the image data, in which a necessary editing, for example, alteration of page order, inversion of images, or double sided copying, is added.

Further, a sheet reversing mechanism 720 for reversing the front and back sides of a copied sheet is installed near the sheet ejection portion 724 of the copying machine 700.

Figure 10:
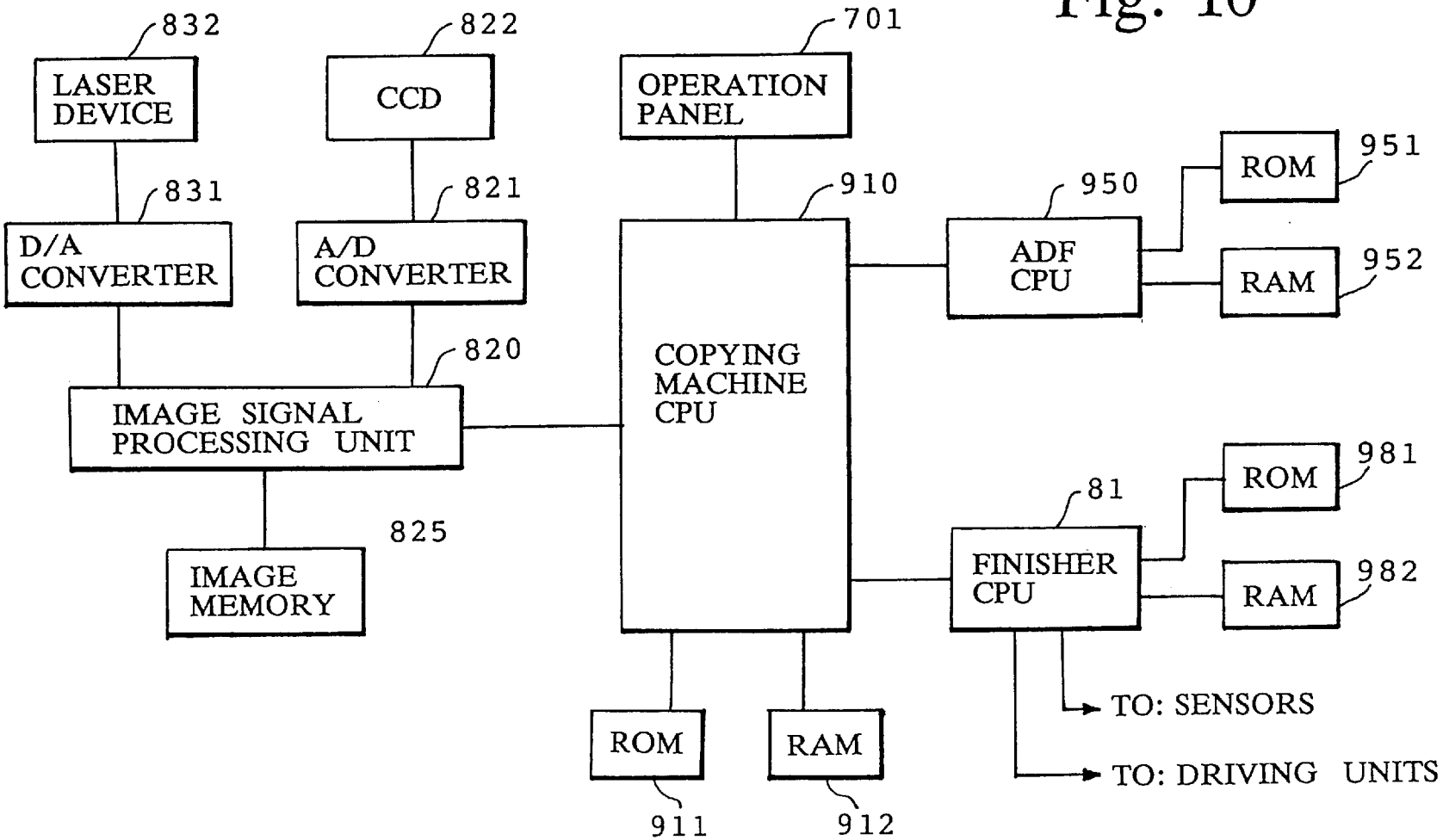
FIG. 10 is a block diagram of a control circuit of the image forming apparatus configured with the finisher coupled to the copying machine.

FIG. 10 is a block diagram illustrating a control circuit of the image forming apparatus configured with the finisher coupled to the copying machine.

The major part of this control circuit is a copying machine CPU 910 that controls the operation of the copying machine, an ADF CPU 950 that controls the operation of the ADF 750, and the finisher CPU 81 that controls the operation of the finisher. These CPUs 910, 950, 81 are provided with ROMs 911, 951, 981, respectively, which store the corresponding control programs, and RAMs 912, 952, 982 being the work areas.

The copying machine CPU 910 is provided with an image memory 825 that stores read images, and an image signal processing unit 820 that executes, on the basis of the image information stored in this image memory 825, the image processing such as an image rotation, image enlargement, image contraction, etc.

Further, a CCD line sensor 822 of the image reader is connected to the image signal processing unit 820 through an A/D converter 821. The A/D converter 821 converts the analog signals read by the CCD line sensor 822 into the digital signals, and the converted results are inputted to the CPU 910.

Further, the image signal processing unit 820 is connected to a D/A converter 831 that converts the digital signals of the image information into the analog signals, and the converted analog signals drive a laser device 832 of an image forming unit (not illustrated).

To the finisher CPU 81 are connected, as described above, various drive means such as the motor or solenoids to execute the operations of various units in the finisher 100, and various sensors installed along the sheet conveyor and in the folding unit 200 of the finisher.

The copying machine CPU 910 outputs the signal to the finisher CPU 81, which instructs or inhibits the execution of folding, punching, stapling, sorting, or the like in accordance with the input signal from an operation panel 701.

As described above, the finisher of this invention is provided with the first conveyance roller and the second conveyance roller disposed on the upstream side from the first, and when the sheet sensor installed on the upstream in the conveyance direction of the sheet detects the sheet, a loop of the sheet is formed between the first and second conveyance rollers by the conveyance speed difference obtained by switching the conveyance speed of the second conveyance roller into the higher conveyance speed. Thereby, the trailing edge of the sheet is positioned, and the punching can be carried out to the sheet thus positioned during the conveyance of the sheet. Therefore, compared with the conventional apparatus, the finisher of this invention will significantly restrict the dispersion of the punching positions and execute the punching at specific positions precisely and continuously.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet puncher comprising:

a first conveyance device that conveys a sheet at a first conveyance speed;

a second conveyance device disposed on the upstream side from the first conveyance device in the conveyance direction of the sheet, which conveys the sheet at the first conveyance speed and switches the speed into a second conveyance speed being higher than the first to convey the sheet;

a punching device to punch the sheet, disposed between the first conveyance device and the second conveyance device;

a sheet position detection sensor to detect a position of the sheet, which is disposed on the upstream side from the second conveyance device in the conveyance direction of the sheet; and a control unit that controls to switch the sheet conveyance speed of the second conveyance device on the basis of a detection result of the sheet position detection sensor.

2. A sheet puncher as claimed in claim 1, wherein said control unit switches the sheet conveyance speed of said second conveyance device from the first conveyance speed into the second conveyance speed when said sheet position detection sensor detects a trailing edge of the sheet.

3. A sheet puncher as claimed in claim 2, wherein said control unit switches the sheet conveyance speed of said second conveyance device into the first conveyance speed when the trailing edge of the sheet reaches a nip of said second conveyance device.

4. A sheet puncher as claimed in claim 3, further comprising a timer that starts to measure time when said sheet position detection sensor detects the trailing edge of the sheet, wherein said control unit switches the sheet conveyance speed of said second conveyance device into the first conveyance speed when said timer completes to measure a specific time.

5. A sheet puncher as claimed in claim 1, wherein the sheet conveyance speed of said first conveyance device is maintained at the first conveyance speed while said second conveyance device is driven at the second conveyance speed.

6. A sheet puncher as claimed in claim 1, wherein said control unit controls to execute or inhibit a sheet punching operation on the basis of an instruction signal inputted from outside.

7. An image forming apparatus comprising:

an image forming means that forms an image on a sheet;

a first conveyance device that conveys the sheet on which the image is formed by the image forming means at a first conveyance speed;

a second conveyance device disposed on the upstream side from the first conveyance device in the conveyance direction of the sheet, which conveys the sheet at the first conveyance speed and switches the speed into a second conveyance speed being higher than the first to convey the sheet;

a punching device to punch the sheet, disposed between the first conveyance device and the second conveyance device;

a sheet position detection sensor to detect a position of the sheet, which is disposed on the upstream side from the second conveyance device in the conveyance direction of the sheet; and a control unit that controls to switch the sheet conveyance speed of the second conveyance device on the basis of a detection result of the sheet-position detection sensor.

8. An image forming apparatus as claimed in claim 7, wherein said control unit switches the sheet conveyance speed of said second conveyance device from the first conveyance speed into the second conveyance speed when the sheet position detection sensor detects a trailing edge of the sheet.

9. An image forming apparatus as claimed in claim 8, wherein said control unit switches the sheet conveyance speed of said second conveyance device into the first conveyance speed when the trailing edge of the sheet reaches a nip of said second conveyance device.

10. An image forming apparatus as claimed in claim 9, further comprising a timer that starts to measure time when said sheet position detection sensor detects the trailing edge of the sheet, wherein said control unit switches the sheet conveyance speed of said second conveyance device into the first conveyance speed when said timer completes measuring a specific time.

11. An image forming apparatus as claimed in claim 7, wherein the sheet conveyance speed of said first conveyance device is maintained at the first conveyance speed while said second conveyance device is driven at the second conveyance speed.

12. A finisher that executes a finishing of a sheet outputted from an image forming apparatus, comprising:

a first conveyance device that conveys a sheet at a first conveyance speed;

a second conveyance device disposed on the upstream side from the first conveyance device in the conveyance direction of the sheet, which conveys the sheet at the first conveyance speed and switches the speed into a second conveyance speed being higher than the first to convey the sheet;

a punching device to punch the sheet, disposed between the first conveyance device and the second conveyance device;

a sheet position detection sensor to detect a position of the sheet, which is disposed on the upstream side from the second conveyance device in the conveyance direction of the sheet; and a control unit that controls to switch the sheet conveyance speed of the second conveyance device on the basis of a detection result of the sheet position detection sensor.

13. A finisher as claimed in claim 12, wherein said control unit switches the sheet conveyance speed of said second conveyance device from the first conveyance speed into the second conveyance speed when said sheet position detection sensor detects a trailing edge of the sheet.

14. A finisher as claimed in claim 13, wherein said control unit switches the sheet conveyance speed of said second conveyance device into the first conveyance speed when the trailing edge of the sheet reaches a nip of said second conveyance device.

15. A finisher as claimed in claim 14, further comprising a timer that starts to measure time when said sheet position detection sensor detects the trailing edge of the sheet, wherein said control unit switches the sheet conveyance speed of said second conveyance device into the first conveyance speed when said timer completes measuring a specific time.

16. A finisher as claimed in claim 12, wherein the sheet conveyance speed of said first conveyance device is maintained at the first conveyance speed while said second conveyance device is driven at the second conveyance speed.

17. A finisher as claimed in claim 12, wherein said control unit controls to execute or inhibit a sheet punching operation on the basis of an instruction signal inputted from the image forming apparatus.

18. A sheet puncher as claimed in claim 1, wherein said first conveyance speed of the first conveyance device is larger than zero.

19. An image forming apparatus as claimed in claim 7, wherein said first conveyance speed of the first conveyance device is larger than zero.

20. A finisher as claimed in claim 12, wherein said first conveyance speed of the first conveyance device is larger than zero.

* * * * *